US005513754A

United States Patent [19]

Chang

[11] Patent Number: 5,513,754

[45] Date of Patent: May 7, 1996

[54] BEAUTY KIT

[76] Inventor: Chia-Hao Chang, 7/F-2, No. 442, Chang-Chun Rd., Sung-Shan Dist., Taipei City, Taiwan

[21] Appl. No.: 455,722

[22] Filed: May 31, 1995

[51] Int. Cl.[6] ..... B65D 69/00

[52] U.S. Cl. ..... 206/581; 206/235; 132/296; 132/313; 132/315

[58] Field of Search ..... 206/38, 235, 581; 132/294, 296, 313, 315

[56] References Cited

U.S. PATENT DOCUMENTS

| | | | |
|---|---|---|---|
| 1,368,735 | 2/1921 | Lang | 132/313 |
| 4,555,020 | 11/1985 | Campello et al. | 206/581 |
| 4,716,915 | 1/1988 | Burns | 132/313 |
| 5,226,541 | 7/1993 | Huang | 206/581 |
| 5,337,890 | 8/1994 | Lai | 206/581 |

*Primary Examiner*—David T. Fidei
*Attorney, Agent, or Firm*—Morton J. Rosenberg; David I. Klein

[57] ABSTRACT

A beauty kit including a bottom case defining an upper chamber for receiving foundations and flushes and a bottom chamber for receiving a file and an eye pencil, a mirror pivoted to the bottom case for closing the upper chamber, a folding brush pivoted to the bottom case for closing the bottom chamber, and an upper case pivoted to the bottom case and turned between a close position closed on the bottom case and an open position moved away from the bottom case, the upper case having a horizontal receptacle at the top, which receives a perfume container, a spring-supported steel ball, which engages a retaining hole on the perfume container to hold the perfume container in place, a plurality of clamping plates retained in place by retainers to hold different colors of nail enamels, a cover plate pivotably connected to a top side thereof by pivot pins for holding down the nail enamels.

2 Claims, 3 Drawing Sheets

BEAUTY KIT

BACKGROUND OF THE INVENTION

The present invention relates to a beauty kit which is comprised of an upper case, a bottom case pivotably connected to the upper case, a mirror pivoted to the bottom case at the top, a folding brush pivoted to the bottom case at the bottom, a perfume container attached to the upper case at the top, and a variety of beauty products received in the upper case and the bottom case.

Various cosmetic bags and cases have been disclosed for carrying a variety of beauty products, and have appeared on the market. When a cosmetic bag is used to carry beauty products, beauty products will be deformed or damaged when the cosmetic bag is crushed or squeezed. Regular cosmetic cases generally have a hard shell for protection. However, these cosmetic cases have only a limited number of compartments for keeping limited beauty products.

SUMMARY OF THE INVENTION

The present invention has been accomplished under to provide a beauty kit which combines different cases and a variety of beauty products together. According to the preferred embodiment of the present invention, the beauty kit comprises a bottom case defining an upper chamber for receiving foundations and flushes and a bottom chamber for receiving a file and an eye pencil, a mirror pivoted to the bottom case for closing the upper chamber, a folding brush pivoted to the bottom case for closing the bottom chamber, and an upper case pivoted to the bottom case and turned between a close position closed on the bottom case and an open position moved away from the bottom case, wherein the upper case comprises a horizontal receptacle at the top, which receives a perfume container, a spring-supported steel ball, which engages a retaining hole on the perfume container to hold the perfume container in place, a plurality of clamping plates retained in place by retainers to hold different colors of nail enamels, a cover plate pivotably connected to a top side thereof by pivot pins for holding down the nail enamels.

DETAILED DESCRIPTION OF THE PREFERRED EMBODIMENT

Figure 1:
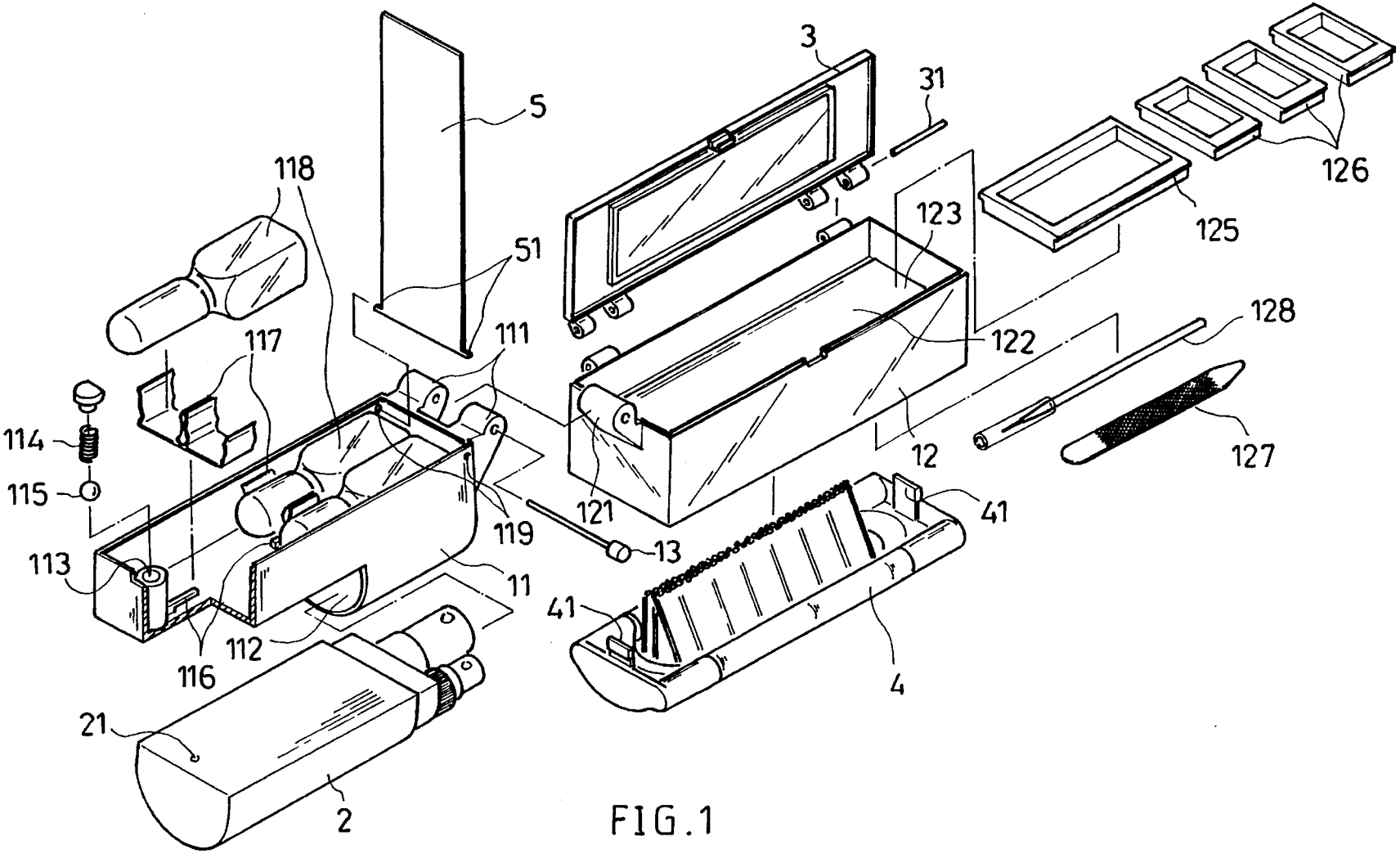
FIG. 1 is an exploded view of a beauty kit according to the preferred embodiment of the present invention.
Figure 4:
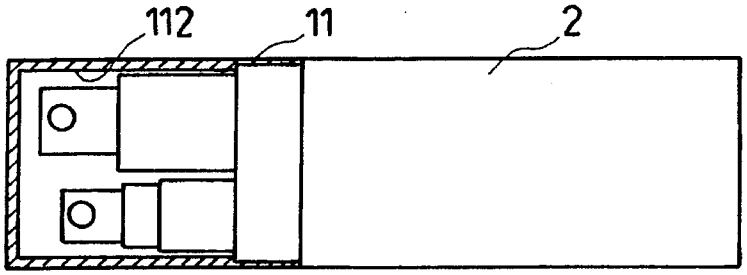
FIG. 4 is a top view in section of the beauty kit shown in FIG. 1.
Figure 3:
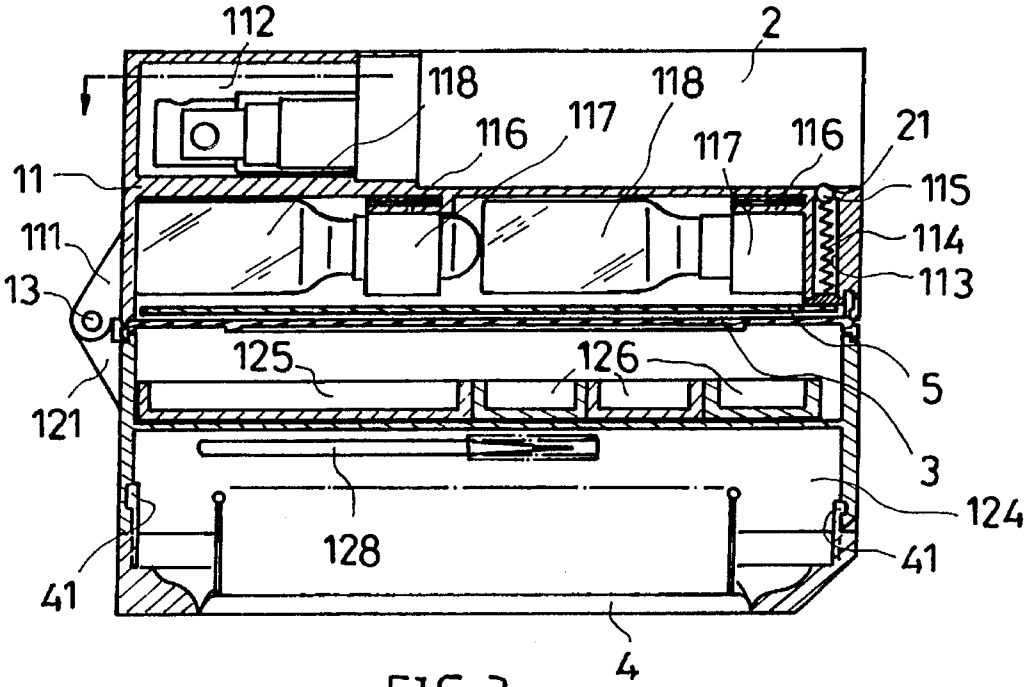
FIG. 3 is a sectional elevation of the beauty kit shown in FIG. 1.
Figure 2:
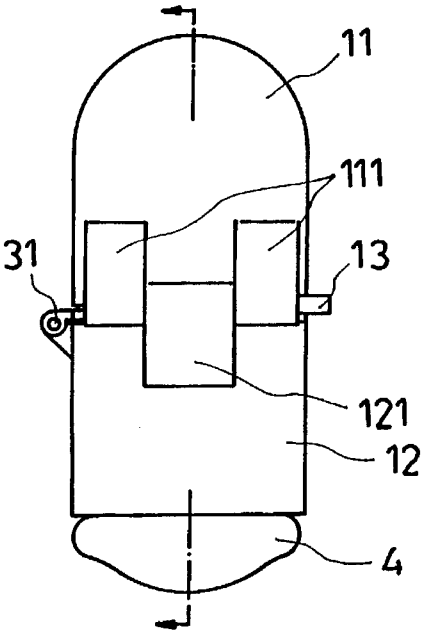
FIG. 2 is a left end view of the beauty kit shown in FIG. 1.
Figure 5:
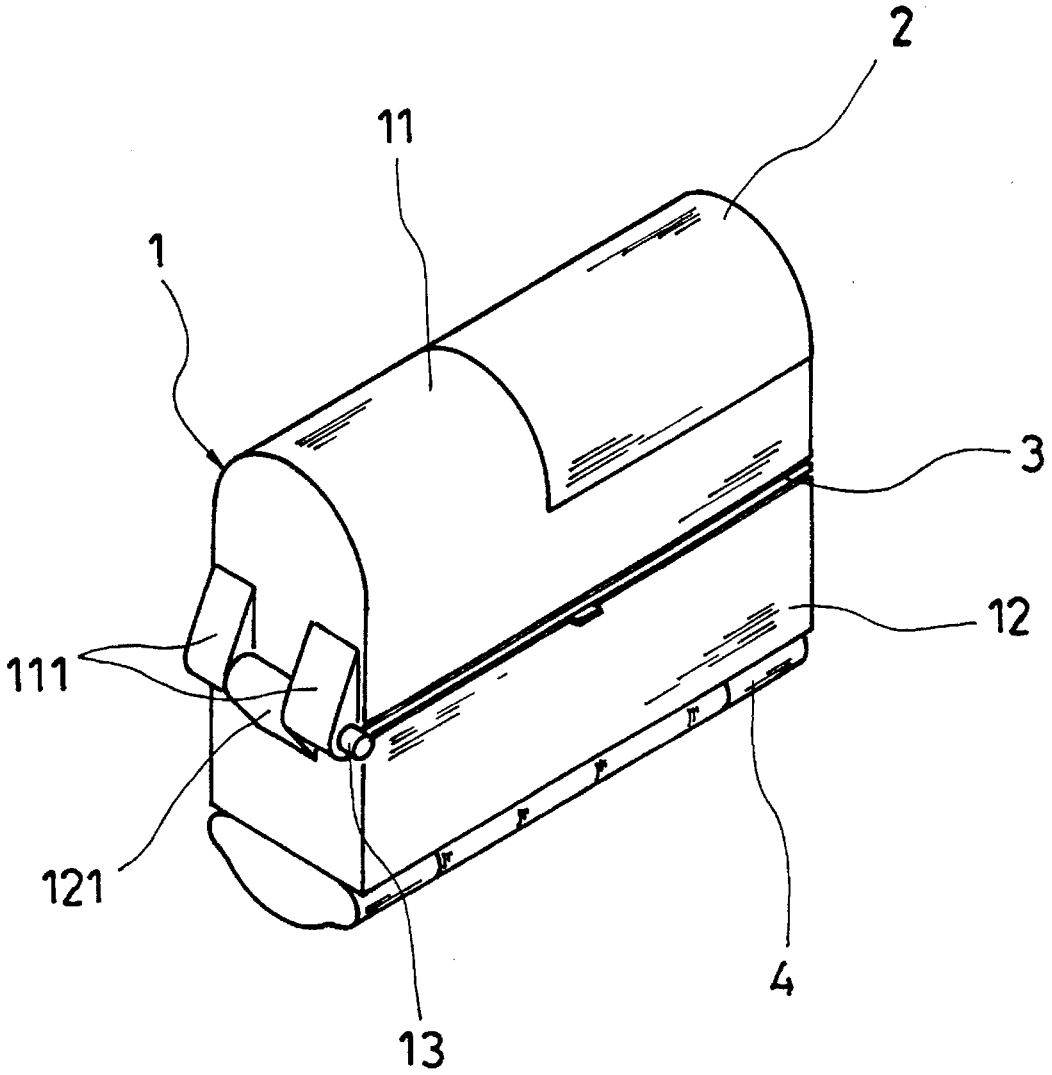
FIG. 5 is an elevational view of the beauty kit shown in FIG. 1.

Referring to FIGS. 1, 2, 3, 4, and 5, the beauty kit, referenced by 1, is comprised of an upper case 11, a bottom case 12, a perfume container 2, a mirror 3, and a folding brush 4. The upper case 11 has a coupling portion 111 at one end pivotably connected to a corresponding coupling portion 121 at one end of the bottom case 12 by a pivot 13, and therefore the upper case 11 and the bottom case 12 can be opened and closed by turning one relative to the other. The upper case 11 further comprises a horizontal receptacle 112 at the top side, which receives the perfume container 2, a spring 114, a steel ball 155 forced into a retaining hole 21 on the perfume container 2 by the spring 114 to hold the perfume container 2 in place. The bottom case 12 is divided by a partition board 122 into an upper chamber 123, which receives a foundation 125 and a plurality of flushes 126, and a bottom chamber 124, which receives a file 127 and an eye pencil 128. The mirror 3 is pivotably connected to the bottom case 12 by a pivot 31 at by side for closing the upper chamber 123. The folding brush 4 is detachably connected to the bottom case 12 by retainers 41 thereof to close the bottom chamber 124. The upper case 11 further comprises a plurality of clamping plates 117 retained in place by retainers 116 to hold different colors of nail enamels 118. A cover plate 5 is pivotably connected to the upper case 11 to cover the nail enamels 118, having two pivot pins 51 aligned at one side and inserted into respective pivot holes 119 on the upper case 11.

It is to be understood that the drawings are designed for purposes of illustration only, and are not intended as a definition of the limits and scope of the invention disclosed.

I claim:

1. A beauty kit comprising:

a bottom case having an inside space divided by a partition board thereof into an upper chamber for receiving foundations and flushes and a bottom chamber for receiving a file and an eye pencil;

a mirror pivotably connected to said bottom case by a pivot for closing said upper chamber;

a folding brush pivotably connected to said bottom case by a pivot for closing said bottom chamber;

a perfume container having a retaining hole;

and an upper case pivoted to one end of said bottom case and turned between a close position closed on said bottom case and an open position moved away from said bottom case, said upper case comprising a horizontal receptacle on a top side thereof, which receives said perfume container, a spring, a steel ball forced into the retaining hole on said perfume container by said spring to hold said perfume container in place, a plurality of clamping plates retained in place by retainers to hold different colors of nail enamels, a cover plate pivotably connected to a top side thereof by pivot pins for holding down said nail enamels.

2. The beauty kit of claim 1 wherein said clamping plates can be detached from said upper case for permitting said upper case to hold other beauty products.

* * * * *